US006617268B1

(12) United States Patent
Offord et al.

(10) Patent No.: US 6,617,268 B1
(45) Date of Patent: Sep. 9, 2003

(54) METHOD FOR PROTECTING COTTON FROM ENZYMATIC ATTACK BY CELLULASE ENZYMES

(75) Inventors: David A. Offord, Castro Valley, CA (US); David S. Soane, Piedmont, CA (US); William Ware, Jr., Woodside, CA (US); Matthew R. Linford, Oakland, CA (US)

(73) Assignee: Nano-Tex, LLC, Emeryville, CA (US)

( * ) Notice: Subject to any disclaimer, the term of this patent is extended or adjusted under 35 U.S.C. 154(b) by 0 days.

(21) Appl. No.: 09/603,814

(22) Filed: Jun. 26, 2000

Related U.S. Application Data

(60) Provisional application No. 60/142,614, filed on Jul. 7, 1999.

(51) Int. Cl.[7] ..... D03D 15/00
(52) U.S. Cl. ..... 442/187; 442/301
(58) Field of Search ..... 442/125, 187, 442/123, 301

(56) References Cited

U.S. PATENT DOCUMENTS 4,605,418 A * 8/1986 Christie et al. ..... 8/192
4,808,479 A * 2/1989 Fox ..... 428/394
4,832,864 A 5/1989 Olson ..... 252/174.12
5,654,193 A 8/1997 Clarkson et al. ..... 435/263
5,690,694 A 11/1997 Kang ..... 8/102
5,914,443 A 6/1999 Kalum ..... 8/401
6,077,316 A * 6/2000 Lund et al. ..... 8/115.6

FOREIGN PATENT DOCUMENTS

EP 0 290 027 A2 9/1988

* cited by examiner

*Primary Examiner*—Cheryl A. Juska
*Assistant Examiner*—Christopher C. Pratt
(74) *Attorney, Agent, or Firm*—Jacqueline S. Larson

(57) ABSTRACT

This invention is directed to methods for the treatment of cellulose-containing fibers and yarn to provide protection to the cellulose from attack by enzymes. The method comprises the steps of exposing cellulose-containing fibers and yarn to an aqueous solution of an enzyme-repelling chemical to give the fibers or yarn a protective coating, and using the protectively coated fibers and yarn to prepare cloth or fabric. In another embodiment, the method of the invention comprises the step of exposing a fabric comprising cellulose-containing yarn to an aqueous solution of an enzyme-repelling chemical to give the fabric a protective coating. The invention also encompasses cellulose-containing fibers and yarn, including cotton, having a protective enzyme-repelling coating. The invention is further directed to denim fabric comprising cotton fill yarn having a protective enzyme-repelling coating. Such denim fabric, and any garments made therefrom, will exhibit greater strength and durability following the stonewashing procedure as compared to denim made from uncoated yarn.

20 Claims, No Drawings

METHOD FOR PROTECTING COTTON FROM ENZYMATIC ATTACK BY CELLULASE ENZYMES

REFERENCE TO RELATED APPLICATIONS

This claims the benefit of co-pending Provisional U.S. Application Ser. No. 60/142,614, filed Jul. 7, 1999, the disclosure of which is incorporated herein by reference in its entirety.

FIELD OF THE INVENTION

This invention is directed to the field of treatment of fibers, yarns and fabrics. More specifically, this invention relates to a method for protecting cotton and other cellulosics from enzymatic attack by cellulase enzymes, and to the cotton and other cellulosic fibers and fabrics so treated.

BACKGROUND OF THE INVENTION

Denim is a woven fabric formed by interlacing or intermeshing yarns made of cotton or other cellulosic fibers, usually in a 2/1 twill weave. The machine direction or direction of weaving is called the "warp" direction, and the cross-machine direction is called the weft, filling, or "fill". The warp yarns alternately go over and under the fill yarns. The warp yarn in denim is typically dyed with indigo, a naturally occurring blue dye, prior to weaving. The fabric produced by weaving indigo-dyed warp yarn with white fill yarn results in the typical denim look.

Denim garments, especially jeans, are often "stonewashed" or similarly finished to give a worn look. Originally, garments were washed with soft pumice stones, or the like, to remove some indigo dye and give this worn look. Later it was found that the addition of cellulase enzyme to the washing solution greatly decreased the amount of time needed for stonewashing by partially digesting and exposing more of the warp yarn to the abrasive action of the stones. However, since the enzyme does not distinguish between fill and warp yarns, the fill yarns are also, unnecessarily, attacked, and undesired garment weakening occurs. If the enzyme could be directed away from the fill yarn but remain available to and effective on the dyed warp yarn, a stronger stonewashed garment could be produced.

SUMMARY OF THE INVENTION

This invention is directed to methods for the treatment of cellulose-containing fibers and yarn to provide protection to the cellulosic material from attack by enzymes. More particularly, it describes the deposition of a protective coating on the fibers in the yarn (intended in one embodiment as the fill yarn of a denim fabric) to protect it from cellulase degradation during the stonewashing process. The method comprises the steps of exposing cotton-or other cellulose-containing fiber or yarn to an aqueous solution of an enzyme-repelling chemical to give the fiber or yarn a protective coating, and using the protectively coated fibers and yarn to prepare cloth or fabric. In another embodiment, the method of the invention comprises the step of exposing a fabric comprising cotton-or other cellulose-containing yarn to an aqueous solution of an enzyme-repelling chemical to give the fabric a protective coating.

The invention also encompasses fibers, yarn and fabric (all of which are encompassed herein and in the appended claims within the term "web") having a protective enzyme-repelling coating. Such yarns can be used as the fill yarn in the manufacture of denim and will not be degraded in the presence of cellulase enzyme in the denim stonewashing process. Use of the coated yarn and fibers is not, however, limited to denim but may be used in other fabrics as well.

The invention is further directed to denim fabric comprising cotton fibers and yarn having a protective enzyme-repelling coating. Such denim fabric, and any garments made therefrom, will exhibit greater strength and durability following the stonewashing procedure as compared to denim made from uncoated yarn.

DETAILED DESCRIPTION OF THE INVENTION

The "cellulose-containing" or "cellulosic" fibers, yarns, and fabrics to be treated according to the present invention include any cellulosic fiber and any blend of fibers that contains a cellulosic, whether as a majority or a minority component. Cellulosic-based webs include paper, cotton, rayon and other regenerated cellulosics and cellulose-containing materials, linen, jute, ramie, industrial hemp, and the like.

The "enzyme-repelling chemicals" useful in the present invention to coat cotton or other cellulose-containing fibers and yarns are polymers, which polymers are water-soluble and have an affinity for the fiber to be treated or can be covalently attached to the fiber. Additionally, once the polymer is adsorbed onto the fiber, the polymer will have a very slow rate of dissolution back into water. In other words, the polymers to be selected for use must have a higher affinity for the fiber than for water, but still be soluble in water to be of practical interest. Such polymers are known in the art or can be determined without undue experimentation by methods known in the art. The polymer can be chosen from, for example, hydroxyethyl cellulose, polyacrylamide, polyacrylic acid, poly(acrylamide-acrylic acid Na salt), poly(acrylic acid) Na salt, poly(ethyleneglycol dimethyl ether), polyethylene glycol, poly(N-vinyl pyrrolidone), poly(propyleneglycol) diglicidyl ether, poly (sodium 4-styrene sulfonate), poly(vinylsulfonic acid Na salt), poly(4-vinylpyridine), carboxymethyl cellulose Na salt, methyl cellulose, ethyl cellulose, cellulose acetate, poly(vinyl alcohol), poly(ethylene-co-acrylic acid), soluble starch, and polyethylenimine. Of these polymers, the presently preferred coatings are polyethylenimine (PEI) and methyl cellulose, with methyl cellulose being the most preferred.

Crosslinking agents may optionally be included to increase the durability of the polymer on the web substrate. Such crosslinking agents include, but are not limited to, DMDHEU, poly(acrylic acid), and butane tetracarboxylic acid, for example. When included, the crosslinking agent will be present in an amount from about 0.1 wt % to about 10 wt %, preferably from about 1 wt % to about 3 wt %.

The cellulosic fiber, yarn or fabric is exposed to an aqueous solution of the polymer, by methods known in the art such as by soaking, spraying, dipping, fluid-flow in a dye kier, padding, and the like. The polymer-coated ("polymer-protected") yarn or fabric is then removed from the solution, with, if desired, removal of excess solution by squeezing, and then dried. The concentration of the polymer in solution can be from about 0.01% to about 75%, preferably from about 0.75% to about 25%, more preferably from about 1 % to about 10%; depending, however, on the characteristics of the particular polymer selected. For example, the practical upper limit for methyl cellulose is 5%, because it becomes very viscous above that concentration, whereas PEI can be at a concentration of up to at least 25% or higher.

The process temperature can vary widely, depending on the affinity of the polymer for the substrate and whether or not a crosslinking agent is present. However, the temperature should not be so high as to decompose the reactants or so low as to cause inhibition of the reaction or freezing of the solvent. Unless specified to the contrary, the processes described herein take place at atmospheric pressure over a temperature range from about 5° C. to about 185° C., more preferably from about 10°C. to about 50° C., and most preferably at "room" or "ambient" temperature ("RT"), e.g. about 20° C. The time required for the processes herein will depend to a large extent on the temperature being used and the relative reactivities of the starting materials. Therefore, the time of exposure of the cellulosic material to the polymer in solution can vary greatly, for example from about five seconds to about two days. Normally, the exposure time will be from about 1 to 20 minutes. Following exposure, excess solution may be removed, and the treated yarn or fabric is dried at ambient temperature or at a temperature above ambient, up to about 210° C. The pH of the solution should be kept at neutral to basic, because cotton will degrade in acid. Additionally, the deposition of polymer coatings with charged groups (e.g., amines, carboxylates, and the like) is expected to be dependent on solution pH. Salts (such as, for example, NaCI) may optionally be added to increase the rate of adsorption of anionic and cationic polymers onto the cellulose-containing fibers. Unless otherwise specified, the process times and conditions are intended to be approximate.

The polymer-protected cellulose-containing yarn is then used to prepare fabric, most usually by weaving. In a presently preferred embodiment, the cellulose-containing fiber, yarn, or fabric is cotton. In another presently preferred embodiment, polymer-protected cotton yarn is used as the fill yarn in the preparation of denim fabric.

EXAMPLES

EXAMPLE 1

Several water-soluble polymers were analyzed for their ability to protect cotton from degradation by cellulase. The polymers tested are listed in Table I, below.

Polymer Treatment

100% Cotton fabric swatches (Kleen-Bore brand, 2.25"× 2.25") were dried in the oven at 85°C. for ten minutes, after which they were allowed to sit at room temperature for five minutes and were then weighed. A cotton swatch was soaked in a 20 mL vial of polymer for one hour. The swatches were then removed and washed by dipping the swatch into a beaker filled with tap water. The swatch was also rinsed with tap water using a squirt bottle. Neither wash was thorough. The swatches were then left to air-dry overnight. The next day, the swatches were dried in the oven at 85° C. for ten minutes.

Enzyme Treatment

Following the polymer treatment, the cotton fabric swatches were subjected to an enzyme degradation treatment. The enzyme solution was prepared by adding 0.6255 g of cellulase enzyme (Sigma C-8546 Lot 28H0762, cellulase from Trichoderma reesel) to 400 mL of 50 mM sodium acetate solution. The cotton swatches were then placed in individual 10 mL conical vials, and 10 mL of the enzyme solution was added to each of the conical vials. In addition to the swatches treated with various polymers, two untreated swatches were added as controls. One untreated swatch was placed in a 10 mL conical vial containing 10 mL of enzyme solution (254 mg/dL, sample 21 in Table I), while the other untreated swatch was place in 10 mL of buffer solution (no enzyme; to determine the background glucose content of cotton) (16 mg/dL, sample 22 in Table I). All vials were then placed in a shaking water bath with the water temperature at 37° C. After a 22-hour incubation period, a 300 pL sample of the supernatant solution was removed from each of the vials and placed in a new vial. The solution was then analyzed for free glucose (in mg/dL), the product of cellulase acting on cellulose (cotton is composed of cellulose). A glucose assay was performed on each of the supernatant samples in duplicate and averaged. The glucose assay was performed according to Sigma Diagnostics Procedure No. 635. To each of the samples, as well as a blank (water only) and a standard (Sigma Glucose Standard Solution, Catalog No. 635-100), 5.0 mL of o-toluidine reagent (Sigma, Catalog No. 635-6) was added. The vials were then placed in a boiling water bath for exactly ten minutes and then removed and placed in a cold tap water bath for 3 minutes. The samples were then measured for absorbance at 635 nm using a UV-Vis spectrophotometer. The absorbance readings were then converted into amount of glucose from each of the cotton swatches using a glucose calibration curve.

Results

All polymer coatings showed some inhibition to cellulase when compared to untreated cotton (see, Table I). The best coating was 5% methyl cellulose (41 mg/dL), owed by 1% polyethylenimine (99 mg/dL).

TABLE I

Amount of glucose released from cotton samples treated with various water-soluble polymers.

| Sample | Condition | Comments | Glucose Released (mg/dL) After 24 Hrs |
|---|---|---|---|
| 1 | 5% Hydroxyethyl cellulose in H2O, 24K–27K | solution somewhat viscous | 183.33 |
| 2 | 5% Polyacrylamide in H2O, 10K | | 204.63 |
| 3 | 5% Polyacrylic Acid in H2O, 50K | | 197.41 |
| 4 | 5% Poly(acrylamide-acrylic acid, Na salt) in H2O, MW = 200 k, 70% Carboxyl | solution somewhat viscous | 218.89 |
| 5 | 5% Poly(Acrylic acid) Na salt in H2O, 60K | | 233.15 |
| 6 | 5% Poly(ethylene-glycol dimethyl ether), 1K | | 242.59 |
| 7 | 5% Polyethylene glycol in H2O, 35K | | 225.74 |
| 8 | 5% Poly(N-vinyl pyrorolidone) in H2O, 40K | | 228.70 |
| 9 | 5% Poly(propylene glycol) diglicidyl ether in H2O, MW = 640 | solution saturated, actually <5% polymer | 217.04 |

TABLE I-continued

Amount of glucose released from cotton samples treated with various water-soluble polymers.

| Sample | Condition | Comments | Glucose Released (mg/dL) After 24 Hrs |
|---|---|---|---|
| 10 | 5% Poly(Sodium 4-styrene sulfonate) in H2O, 1000K | solution somewhat viscous | 217.96 |
| 11 | 5% Poly(vinylsulfonic acid, Na salt) in H2O, 2K | | 227.59 |
| 12 | 5% Poly(4-vinylpyridine) in H2O, 50K | polymer didn't go into solution, clumped | 213.15 |
| 13 | 5% Carboxymethyl cellulose, Na salt in H2O, 80K | solution somewhat viscous | 206.67 |
| 14 | 5% Methyl cellulose in H2O, 14k, 27.5–31.5 wt % methoxy | solution somewhat viscous | 40.93 |
| 15 | 5% Ethyl Cellulose in H2O, ethoxy content 48% | solution saturated, actually <5% polymer | 196.85 |
| 16 | 5% Cellulose Acetate in H2O, 40 wt % acetyl, 30K | | 210.56 |
| 17 | 5% Poly(vinyl alcohol) in H2O, 31–50K | solution similiar to emulsion | 234.07 |
| 18 | 5% Poly(ethylene-co-acrylic acid), 15 wt % acid | | 226.48 |
| 19 | 5% Soluble starch in H2O | solution saturated, actually <5% polymer | 230.19 |
| 20 | 1% Polyethylenimine in H2O, 750k | | 98.89 |
| 21 | Untreated | | 254.07 |
| 22 | Untreated (no enzyme) | | 16.30 |

EXAMPLE 2

A detailed study of methyl cellulose and polyethylenimine polymer coatings was performed, following the procedure of Example 1 but varying the soaking times and solution concentrations (see, Tables II and III). The study indicated that the protective ability of methyl cellulose increases with increasing concentration but is relatively independent of soak time. Polyethylenimine protection is relatively independent of both concentration and soak time, under the conditions tested.

TABLE II

Effect of polymer concentration and treatment time on the liberation of glucose by cellulase enzyme.

| Conc. of methylecellulose (% by weight) | Treatment Time (min) | Glucose Released after 21 hr incubation (mg/dL) |
|---|---|---|
| Untreated | 0 | 214 |
| 0.1% | 1 | 132 |
| 0.1% | 5 | 130 |
| 0.1% | 10 | 85 |
| 0.5% | 1 | 90 |
| 0.5% | 5 | 101 |
| 0.5% | 10 | 90 |
| 1.0% | 1 | 79 |
| 1.0% | 5 | 81 |
| 1.0% | 10 | 72 |
| 5.0% | 1 | 38 |
| 5.0% | 5 | 36 |
| 5.0% | 10 | 36 |
| Untreated, no enzyme | 0 | 5 |

TABLE III

Effect of polymer concentration and treatment time on the liberation of glucose by cellulase enzyme.

| Conc. of polyethylenimine (% by weight) | Treatment Time (min) | Glucose Released after 24 hr incubation (mg/dL) |
|---|---|---|
| Untreated | 0 | 265 |
| 0.25% | 1 | 138 |
| 0.25% | 5 | 134 |
| 0.25% | 20 | 137 |
| 1.0% | 1 | 140 |
| 1.0% | 5 | 141 |

TABLE III-continued

Effect of polymer concentration and treatment time on the liberation of glucose by cellulase enzyme.

| Conc. of polyethylenimine (% by weight) | Treatment Time (min) | Glucose Released after 24 hr incubation (mg/dL) |
|---|---|---|
| 1.0% | 20 | 142 |
| 5.0% | 1 | 142 |
| 5.0% | 5 | 130 |
| 5.0% | 20 | 120 |
| Untreated, no enzyme | 0 | 4 |

EXAMPLE 3

In another test, methyl cellulose and polyethylenimine were each used to coat cotton fill yarn in a package dye apparatus (i.e., an apparatus where the polymer solutions are flowed through spools of fill yarn). The treated fill yarn from each of the resulting packages was woven with indigo-dyed warp yarn to form denim fabric. This fabric was then subjected to a typical stonewashing procedure and tested for strength, which was improved over the untreated control sample.

What is claimed is:

1. Denim fabric comprising fill yarn that has been treated with an enzyme-repelling chemical and warp yarn that has not been treated with an enzyme-repelling chemical.

2. Denim fabric according to claim 1 wherein said enzyme-repelling chemical is selected from the group consisting of hydroxyethyl cellulose, polyacrylamide, polyacrylic acid, poly(acrylamide-acrylic acid Na salt), poly (acrylic acid) Na salt, poly(ethyleneglycol dimethyl ether), polyethylene glycol, poly(N-vinyl pyrrolidone), poly (propyleneglycol) diglicidyl ether, poly(sodium 4-styrene sulfonate), poly(vinylsulfonic acid Na salt), poly(4-vinylpyridine), carboxymethyl cellulose Na salt, methyl cellulose, ethyl cellulose, cellulose acetate, poly(vinyl alcohol), poly(ethylene-co-acrylic acid), soluble starch, and polyethylenimine.

3. Denim fabric according to claim 1 wherein said enzyme-repelling chemical is polyethylenimine.

4. Denim fabric according to claim 1 wherein said enzyme-repelling chemical is methyl cellulose.

5. Fabric comprising cellulose-containing fill yarn that has been treated with an enzyme-repelling chemical and warp yarn that has not been treated with an enzyme-repelling chemical.

6. Fabric according to claim 5 wherein said enzyme-repelling chemical is selected from the group consisting of hydroxyethyl cellulose, polyacrylamide, polyacrylic acid, poly(acrylamide-acrylic acid Na salt), poly(acrylic acid) Na salt, poly(ethyleneglycol dimethyl ether), polyethylene glycol, poly(N-vinyl pyrrolidone), poly(propyleneglycol) diglicidyl ether, poly(sodium 4-styrene sulfonate), poly (vinylsulfonic acid Na salt), poly(4-vinylpyridine), carboxymethyl cellulose Na salt, methyl cellulose, ethyl cellulose, cellulose acetate, poly(vinyl alcohol), poly (ethylene-co-acrylic acid), soluble starch, and polyethylenimine.

7. Fabric according to claim 5 wherein said cellulose-containing yarn is selected from the group consisting of cotton, rayon, a regenerated cellulosic, linen, jute, ramie, and industrial hemp.

8. Fabric according to claim 5 wherein said cellulose-containing yarn is cotton.

9. Fabric according to claim 8 wherein said enzyme-repelling chemical is polyethylenimine.

10. Fabric according to claim 8 wherein said enzyme-repelling chemical is methyl cellulose.

11. Treated fabric that exhibits inhibition to cellulase degradation when compared to untreated fabric, said treated fabric comprising cellulose-containing fill yarn that has been treated with an enzyme-repelling chemical and warp yarn that has not been treated with an enzyme-repelling chemical.

12. Treated fabric according to claim 11 wherein said cellulase-repelling chemical is selected from the group consisting of hydroxyethyl cellulose, polyacrylamide, polyacrylic acid, poly(acrylamide-acrylic acid Na salt), poly (acrylic acid) Na salt, poly(ethyleneglycol dimethyl ether), polyethylene glycol, poly(N-vinyl pyrrolidone), poly (propyleneglycol) diglicidyl ether, poly(sodium 4-styrene sulfonate), poly(vinylsulfonic acid Na salt), poly(4-vinylpyridine), carboxymethyl cellulose Na salt, methyl cellulose, ethyl cellulose, cellulose acetate, poly(vinyl alcohol), poly(ethylene-co-acrylic acid), soluble starch, and polyethylenimine.

13. Treated fabric according to claim 11 wherein said cellulose-containing yarn is selected from the group consisting of cotton, rayon, a regenerated cellulosic, linen, jute, ramie, and industrial hemp.

14. Treated fabric according to claim 13 wherein said cellulose-containing yarn is cotton.

15. Treated fabric according to claim 11 wherein said cellulase-repelling chemical is polyethylenimine.

16. Treated fabric according to claim 11 wherein said cellulase-repelling chemical is methyl cellulose.

17. Treated fabric according to claim 11 which is denim fabric comprising cellulose-containing fill yarn that has been treated with a cellulase-repelling chemical.

18. Treated fabric according to claim 17 wherein said cellulase-repelling chemical is selected from the group consisting of hydroxyethyl cellulose, polyacrylamide, polyacrylic acid, poly(acrylamide-acrylic acid Na salt), poly (acrylic acid) Na salt, poly(ethyleneglycol dimethyl ether), polyethylene glycol, poly(N-vinyl pyrrolidone), poly (propyleneglycol) diglicidyl ether, poly(sodium 4-styrene sulfonate), poly(vinylsulfonic acid Na salt), poly(4-vinylpyridine), carboxymethyl cellulose Na salt, methyl cellulose, ethyl cellulose, cellulose acetate, poly(vinyl alcohol), poly(ethylene-co-acrylic acid), soluble starch, and polyethylenimine.

19. Treated fabric according to claim 17 wherein said cellulase-repelling chemical is polyethylenimine.

20. Treated fabric according to claim 17 wherein said cellulase-repelling chemical is methyl cellulose.

* * * * *